US012704083B2

(12) United States Patent
Suzuki et al.

(10) Patent No.: US 12,704,083 B2
(45) Date of Patent: Aug. 11, 2026

(54) TEMPERATURE RAISING MECHANISM FOR BLOW-BY GAS TREATMENT DEVICE AND ENGINE PROVIDED WITH TEMPERATURE RAISING MECHANISM FOR BLOW-BY GAS TREATMENT DEVICE

(71) Applicant: KUBOTA CORPORATION, Osaka (JP)

(72) Inventors: Yu Suzuki, Sakai (JP); Yuki Yoshita, Sakai (JP); Satoshi Shibata, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 273 days.

(21) Appl. No.: 18/565,165

(22) PCT Filed: Feb. 21, 2022

(86) PCT No.: PCT/JP2022/007025
§ 371 (c)(1),
(2) Date: Nov. 29, 2023

(87) PCT Pub. No.: WO2022/254820
PCT Pub. Date: Dec. 8, 2022

(65) Prior Publication Data

US 2024/0287922 A1 Aug. 29, 2024

(30) Foreign Application Priority Data

Jun. 2, 2021 (JP) ..... 2021-093254

(51) Int. Cl.
*F01M 13/04* (2006.01)
*F01M 5/00* (2006.01)
(Continued)

(52) U.S. Cl.
CPC ..... *F01M 13/0416* (2013.01); *F01M 5/001* (2013.01); *F01M 11/02* (2013.01); *F01M 13/02* (2013.01); *F01M 2013/0438* (2013.01)

(58) Field of Classification Search
CPC .... F01M 13/0416; F01M 5/001; F01M 11/02; F01M 13/02; F01M 2013/0438;
(Continued)

(56) References Cited

U.S. PATENT DOCUMENTS 5,329,913 A * 7/1994 Suzuki ..... F01P 7/04 123/573
2015/0354420 A1* 12/2015 Kira ..... F01M 13/00 123/574
(Continued)

FOREIGN PATENT DOCUMENTS

DE 102009017658 A1 * 11/2009 ..... F16K 49/002
DE 102017222770 A1 * 6/2019 ..... F02D 41/22
(Continued)

OTHER PUBLICATIONS

Machine Translation of JP2017141769A PDF File Name: "JP2017141769A_Machine_Translation.pdf" (Year: 2017).*
(Continued)

*Primary Examiner* — Grant Moubry
*Assistant Examiner* — Ruben Picon-Feliciano
(74) *Attorney, Agent, or Firm* — Muncy, Geissler, Olds & Lowe, P.C.

(57) ABSTRACT

A temperature raising mechanism 800 for a blow-by gas treatment device has a head cover 4 assembled to a cylinder head, a blow-by gas treatment device 100 which is disposed in the head cover 4 and treats the blow-by gas, and heating means 600 which is fixed to an outer surface 703 of the head cover 4 and generates heat. The blow-by gas treatment device 100 has a partition wall part 200 which partitions an
(Continued)

inside of the head cover 4 into a plurality of regions, and a separating portion 330 which separates the blow-by gas into oil and gas. The head cover 4 has a heat conducting portion 700 which is in contact with the partition wall part 200 and conducts the heat generated by the heating means 600 to the separating portion 330.

20 Claims, 6 Drawing Sheets

(51) Int. Cl.
*F01M 11/02* (2006.01)
*F01M 13/02* (2006.01)

(58) Field of Classification Search
CPC ... F01M 2013/0455; F01M 2013/0472; F01M 13/00; F01M 13/04; F02F 7/006; Y02T 10/12
See application file for complete search history.

(56) References Cited

U.S. PATENT DOCUMENTS

| | | | | |
|---|---|---|---|---|
| 2017/0276040 | A1* | 9/2017 | Lawrence | F01M 13/04 |
| 2019/0003355 | A1* | 1/2019 | Nakamura | F01M 13/0416 |

FOREIGN PATENT DOCUMENTS

| | | | | |
|---|---|---|---|---|
| JP | 2001-336412 | A | | 12/2001 |
| JP | 2006-194105 | A | | 7/2006 |
| JP | 2013-133779 | A | | 7/2013 |
| JP | 2014-105581 | A | | 6/2014 |
| JP | 2017067021 | A | * | 4/2017 |
| JP | 2017082744 | A | * | 5/2017 |
| JP | 2017141769 | A | * | 8/2017 |
| JP | 2017141770 | A | * | 8/2017 |
| JP | 2019-011699 | A | | 1/2019 |
| JP | 2021-001572 | A | | 1/2021 |
| JP | 2021-008848 | A | | 1/2021 |

OTHER PUBLICATIONS

Machine Translation of JP 2017141770 A PDF File Name: "JP2017141770A_Machine_Translation.pdf" (Year: 2017).*
Machine Translation of DE 102009017658 A1 PDF File Name: "DE102009017658A1_Machine_Translation.pdf" (Year: 2009).*
Machine Translation of JP 2017082744 A PDF File Name: "JP2017082744A_Machine_Translation.pdf" (Year: 2017).*
Machine Translation of JP 2017067021 A PDF File Name: "JP2017067021A_Machine_Translation.pdf" (Year: 2017).*
Machine Translation of DE 102017222770 A1 PDF File Name: "DE102017222770A1_Machine_Translation.pdf" (Year: 2019).*

* cited by examiner

TEMPERATURE RAISING MECHANISM FOR BLOW-BY GAS TREATMENT DEVICE AND ENGINE PROVIDED WITH TEMPERATURE RAISING MECHANISM FOR BLOW-BY GAS TREATMENT DEVICE

TECHNICAL FIELD

The present invention relates to a temperature raising mechanism for a blow-by gas treatment device which is mounted on an internal combustion engine such as a diesel engine and separates the blow-by gas into oil and gas and an engine provided with the temperature raising mechanism for the blow-by gas treatment device.

BACKGROUND ART

In a head cover of the diesel engine, for example, a blow-by gas filter is incorporated. The blow-by gas filter separates the blow-by gas into oil and gas such as a combusted gas. The oil separated from the blow-by gas contains moisture (steam).

PTL 1 discloses a blow-by gas recirculating device. The blow-by gas recirculating device described in the PTL 1 has an oil separator which captures and removes the oil from the blow-by gas mounted inside the head cover. The oil separator has a filter portion with an impactor structure. The filter portion with the impactor structure includes a speed-increasing mechanism which increases a speed of the blow-by gas and a wall surface against which the blow-by gas whose speed was increased is caused to collide.

However, in the oil separator with the structure described above, the moisture contained in the oil might freeze at a low temperature in the speed-increasing mechanism of the filter portion, for example. If the moisture contained in the oil freezes in the speed-increasing mechanism of the filter portion, for example, an internal pressure in a crank case rises, and there is a concern that an optional seal portion is broken. In this point, the blow-by gas recirculating device described in the PTL 1 has a room for improvement.

CITATION LIST

Patent Literature

[PTL 1] Japanese Patent Application Publication No. 2021-8848

SUMMARY OF INVENTION

Technical Problem

The present invention was made in view of the circumstances described above and has an object to provide a temperature raising mechanism for a blow-by gas treatment device which can suppress freezing of moisture contained in blow-by gas at a low temperature and an engine provided with a temperature raising mechanism for a blow-by gas treatment device.

Solution to Problem

The aforementioned problem is solved by the temperature raising mechanism for a blow-by gas treatment device which treats blow-by gas generated in an engine, which is a temperature raising mechanism for a blow-by gas treatment device according to the present invention, including a head cover mounted on a cylinder head of the engine, a blow-by gas treatment device which is disposed in the head cover and treats the blow-by gas, and heating means which is fixed to an outer surface of the head cover and generates heat, characterized in that the blow-by gas treatment device has a partition wall part which is fixed to the head cover and partitions the inside of the head cover into a plurality of regions and a separating portion which is provided on the partition wall part and separates the blow-by gas into oil and gas, and the head cover has a heat conducting portion which is in contact with the partition wall part and conducts heat generated by the heating means to the separating portion.

According to the temperature raising mechanism for the blow-by gas treatment device according to the present invention, the heating means which generates heat is fixed to the outer surface of the head cover. Inside the head cover, the blow-by gas treatment device which treats the blow-by gas generated in the engine is disposed. The blow-by gas treatment device has the partition wall part and the separating portion. The partition wall part is fixed to the head cover and partitions the inside of the head cover into a plurality of regions. The separating portion is provided on the partition wall part and separates the blow-by gas into oil and gas. And the head cover has the heat conducting portion. The heat conducting portion is in contact with the partition wall part and conducts the heat generated by the heating means to the separating portion. As a result, the temperature raising mechanism for the blow-by gas treatment device according to the present invention can suppress freezing of moisture contained in the blow-by gas at a low temperature in the separating portion. Moreover, the heat generated by the heating means is not directly conducted to the separating portion but is conducted to the separating portion via the heat conducting portion of the head cover in contact with the partition wall part of the blow-by gas treatment device. As a result, the temperature raising mechanism for the blow-by gas treatment device according to the present invention can suppress freezing of the moisture contained in the blow-by gas at a low temperature in the separating portion, while the separating portion is suppressed from becoming a high temperature, and carbonization of oil contained in the blow-by gas is suppressed.

In the temperature raising mechanism for the blow-by gas treatment device according to the present invention, preferably, the partition wall part is characterized by having a heat-conduction assisting portion which is in contact with the heat conducting portion, receives the heat generated by the heating means and conducts it to the separating portion, and the outer surface is inclined with respect to an upper surface of the heat-conduction assisting portion.

According to the temperature raising mechanism for the blow-by gas treatment device according to the present invention, the partition wall part has the heat-conduction assisting portion. The heat-conduction assisting portion is in contact with the heat conducting portion, receives the heat generated by the heating means and conducts it to the separating portion. Moreover, the outer surface of the head cover to which the heating means is fixed is inclined with respect to the upper surface of the heat-conduction assisting portion. Thus, a space for forming the heat conducting portion of the head cover thicker than the other parts of the head cover can be ensured inside the head cover. As a result, by using this space, a heat conducting portion, which is thicker than the other parts of the head cover, is provided, whereby a contact surface between the heat conducting portion of the head cover and the heat-conduction assisting portion of the partition wall part can be set wider. Therefore, the temperature raising mechanism for the blow-by gas treatment device according to the present invention can efficiently conduct the heat generated by the heating means to the separating portion via the heat conducting portion of the head cover and the heat-conduction assisting portion of the partition wall part, and freezing of the moisture contained in the blow-by gas at a low temperature in the separating portion can be further suppressed.

In the temperature raising mechanism for the blow-by gas treatment device according to the present invention, preferably, the partition wall part is characterized by having a heat-conduction assisting portion which is in contact with the heat conducting portion, receives heat generated by the heating means and conducts it to the separating portion, and the outer surface is perpendicular to the upper surface of the heat-conduction assisting portion.

According to the temperature raising mechanism for the blow-by gas treatment device according to the present invention, the partition wall part has the heat-conduction assisting portion. The heat-conduction assisting portion is in contact with the heat conducting portion and receives the heat generated by the heating means and conducts it to the separating portion. Moreover, the outer surface of the head cover to which the heating means is fixed is perpendicular to the upper surface of the heat-conduction assisting portion. Thus, while a disposition structure of the heating means is facilitated, a contact area between the heat conducting portion of the head cover and the heat-conduction assisting portion of the partition wall part can be ensured. As a result, the temperature raising mechanism for the blow-by gas treatment device according to the present invention can efficiently conduct the heat generated by the heating means to the separating portion via the heat conducting portion of the head cover and the heat-conduction assisting portion of the partition wall part, while complication of a disposition structure of the heating means is suppressed.

In the temperature raising mechanism for the blow-by gas treatment device according to the present invention, preferably, the heating means is characterized by being a heater having a positive temperature characteristic using a semiconductor ceramic with barium titanate as a main component.

According to the temperature raising mechanism for the blow-by gas treatment device according to the present invention, the heating means is a heater having a positive temperature characteristic using a semiconductor ceramic with barium titanate as a main component. Thus, such a resistance value that rapidly increases at a certain temperature, when a temperature rises, can be set to the heating means. As a result, in the heating means, a large amount of an electric current flows at a low temperature so as to increase a heat generation amount, and as the heat is generated, the resistance value increases, the electric current is limited, and the heat generation amount can be suppressed. Therefore, the temperature raising mechanism for the blow-by gas treatment device according to the present invention can suppress that the separating portion becomes a high temperature, the oil contained in the blow-by gas is carbonized, and the moisture contained in the blow-by gas freezes at a low temperature in the separating portion.

In the temperature raising mechanism for the blow-by gas treatment device according to the present invention, preferably, the thickness of the part in the heat conducting portion in contact with the partition wall part is characterized by being larger than the thickness of the other parts in the heat conducting portion not in contact with the partition wall part.

According to the temperature raising mechanism for the blow-by gas treatment device according to the present invention, the thickness of the part in the heat conducting portion in contact with the partition wall part is larger than the thickness of the other parts in the heat conducting portion not in contact with the partition wall part. Thus, the heat generated by the heating means can be easily conducted to the part in contact with the partition wall part as compared with the other parts of the head cover. Moreover, as compared with the other parts of the head cover, a heat capacity of the part in contact with the partition wall part can be increased. As a result, the temperature raising mechanism for the blow-by gas treatment device according to the present invention can efficiently conduct the heat generated by the heating means to the separating portion and further suppress the freezing of the moisture contained in the blow-by gas at a low temperature in the separating portion.

In the temperature raising mechanism for the blow-by gas treatment device according to the present invention, preferably, the separating portion is characterized by being provided with inclination in a direction in which the oil separated from the blow-by gas by the separating portion is led to an oil guiding portion.

According to the temperature raising mechanism for the blow-by gas treatment device according to the present invention, since the separating portion is inclined in the direction in which the oil separated from the blow-by gas by the separating portion is led to the oil guiding portion, the oil separated from the blow-by gas can be reliably led to the oil guiding portion. As a result, the temperature raising mechanism for the blow-by gas treatment device according to the present invention can suppress the oil from staying in the separating portion and the freezing of the moisture contained in the oil of the blow-by gas at a low temperature in the separating portion.

In the temperature raising mechanism for the blow-by gas treatment device according to the present invention, preferably, the separating portion is characterized by having a flow-velocity raising operation portion which raises a flow velocity of the blow-by gas along a direction inclined with respect to a vertical direction, a filter through which the blow-by gas whose flow velocity is raised by the flow-velocity raising operation portion is passed, and a collision plate against which the blow-by gas having passed through the filter is caused to collide and to be separated into the oil and the gas, in which a surface of the flow-velocity raising operation portion opposed to the collision plate is inclined downward toward the oil guiding portion.

According to the temperature raising mechanism for the blow-by gas treatment device according to the present invention, the flow-velocity raising operation portion causes the blow-by gas to collide against the collision plate, while raising the flow velocity of the blow-by gas along the direction inclined with respect to the vertical direction (up-down direction). As a result, the blow-by gas is reliably separated into oil and gas. And the oil separated from the blow-by gas on the collision plate passes through the filter and drops onto the surface of the flow-velocity raising operation portion opposed to the collision plate. Here, the surface of the flow-velocity raising operation portion is inclined downward toward the oil guiding portion. Thus, the oil having dropped onto the surface of the flow-velocity operation portion flows on the surface of the flow-velocity raising operation portion by its own weight and is led to the oil guiding portion. As a result, the temperature raising mechanism for the blow-by gas treatment device according to the present invention can suppress the oil from staying in the separating portion and suppress the freezing of the moisture contained in the oil of the blow-by gas at a low temperature in the separating portion.

The aforementioned problem is solved by an engine including the temperature raising mechanism for the blow-by gas treatment device which treats the blow-by gas generated in the engine, in which the temperature raising mechanism for the blow-by gas treatment device has a head cover assembled to a cylinder head of the engine, the blow-by gas treatment device which is disposed in the head cover and treats the blow-by gas, and heating means which is fixed to an outer surface of the head cover and generates heat, characterized in that the blow-by gas treatment device has a partition wall part which is fixed to the head cover and partitions an inside of the head cover into a plurality of regions and a separating portion which is provided in the partition wall part and separates the blow-by gas into oil and gas, and the head cover has a heat conducting portion which is in contact with the partition wall part and conducts the heat generated by the heating means to the separating portion.

According to the engine according to the present invention, the heating means of the temperature raising mechanism for the blow-by gas treatment device is fixed to the outer surface of the head cover and generates heat. Inside the head cover, the blow-by gas treatment device which treats the blow-by gas generated in the engine is disposed. The blow-by gas treatment device has the partition wall part and the separating portion. The partition wall part is fixed to the head cover and partitions the inside of the head cover into a plurality of regions. The separating portion is provided in the partition wall part and separates the blow-by gas into oil and gas. And the head cover has a heat conducting portion. The head conducting portion is in contact with the partition wall part and conducts the heat generated by the heating means to the separating portion. As a result, the temperature raising mechanism for the blow-by gas treatment device according to the present invention can suppress freezing of moisture contained in the blow-by gas at a low temperature in the separating portion. Moreover, the heat generated by the heating means is not directly conducted to the separating portion but is conducted to the separating portion via the heat conducting portion of the head cover in contact with the partition wall part of the blow-by gas treatment device. As a result, the temperature raising mechanism for the blow-by gas treatment device according to the present invention can suppress that the separating portion becomes a high temperature, that the oil contained in the blow-by gas is carbonized, and that the moisture contained in the blow-by gas is frozen at a low temperature in the separating portion.

Advantageous Effects of Invention

According to the present invention, the temperature raising mechanism for the blow-by gas treatment device which can suppress freezing of moisture contained in the blow-by gas at a low temperature and an engine including the temperature raising mechanism for the blow-by gas treatment device can be provided.

DESCRIPTION OF EMBODIMENTS

In the following, preferred embodiments of the present invention will be explained in detail with reference to the drawings.

It is to be noted that the embodiments explained below are preferred specific examples of the present invention and thus, various limitations, which are technically preferable, are given, but a scope of the present invention is not limited to these modes unless there is a description that particularly limits the present invention in the following explanation. Moreover, the same signs are given to similar constituent elements in each of the drawings, and detailed explanation will be omitted as appropriate.

First Embodiment (Outline of Engine 1)

Figure 1:
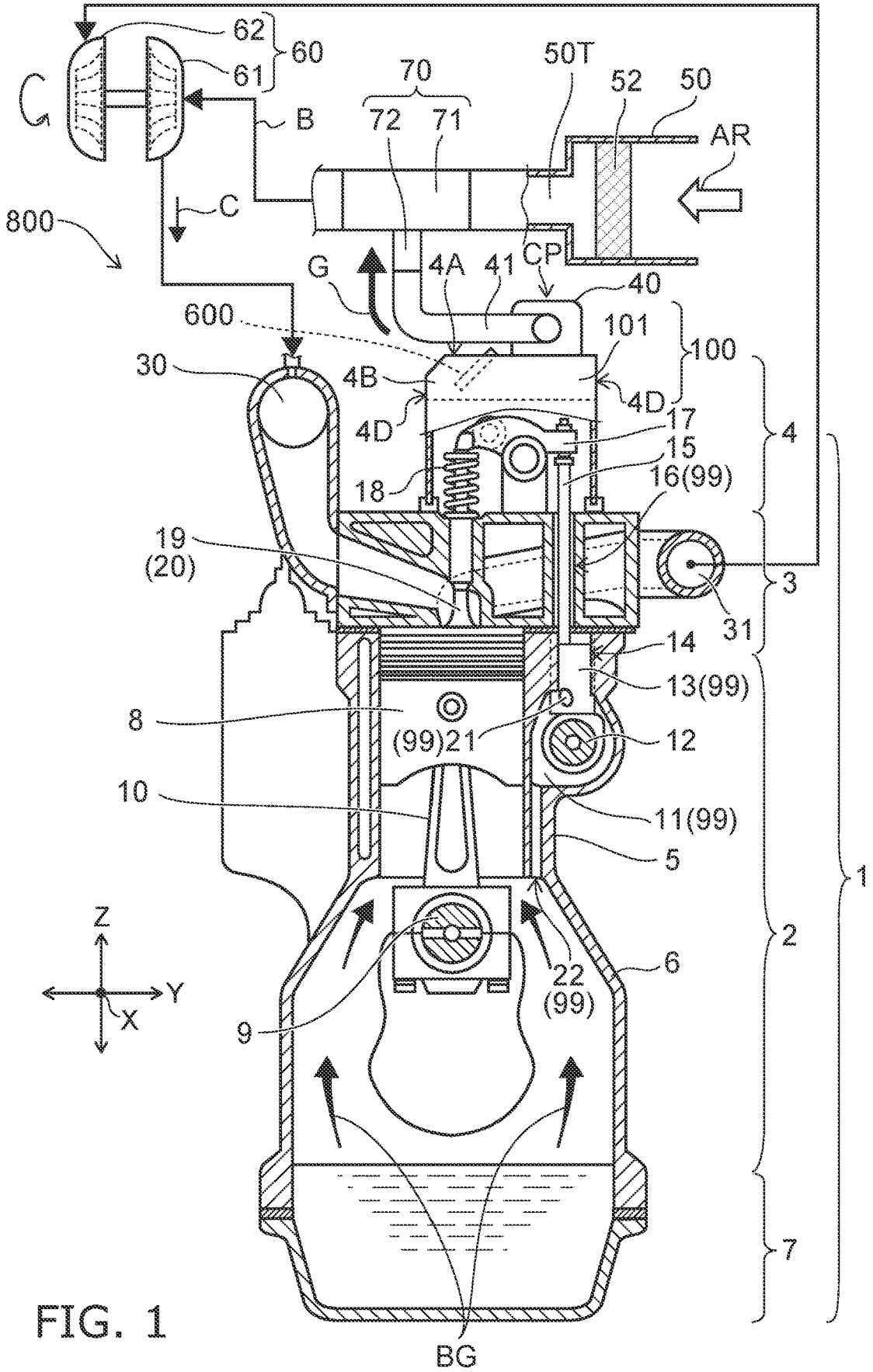
FIG. 1 is a sectional view illustrating an engine including a temperature raising mechanism for a blow-by gas treatment device according to a First Embodiment of the present invention.

FIG. 1 is a sectional view illustrating an engine including a temperature raising mechanism for a blow-by gas treatment device according to a First Embodiment of the present invention.

Figure 2:
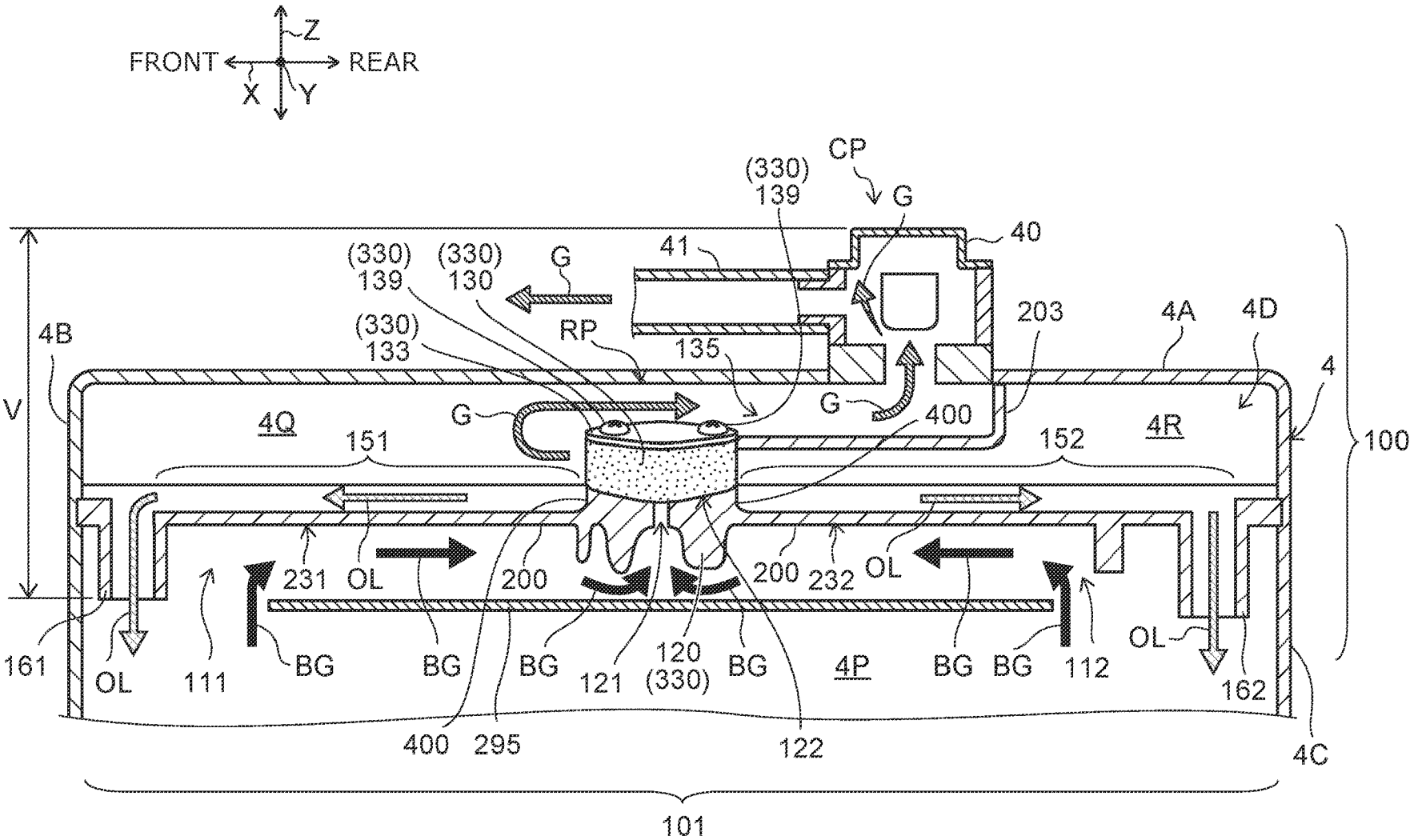
FIG. 2 is a sectional view on an X-Z plane illustrating a structure example of the temperature raising mechanism for the blow-by gas treatment device according to the First Embodiment of the present invention.

FIG. 2 is a sectional view on an X-Z plane illustrating a structure example of the temperature raising mechanism for the blow-by gas treatment device according to the First Embodiment of the present invention.

An engine 1 shown in FIG. 1 is an internal combustion engine and is an industrial diesel engine, for example. The engine 1 is a multi-cylinder engine such as a supercharging-type high-output 3-cylinder or 4-cylinder engine with a turbocharger, for example. The engine 1 is mounted on a vehicle or the like such as a construction machine, an agricultural machine, and a lawnmower.

The engine 1 includes a cylinder block 2, a cylinder head 3, a head cover 4, an oil pun 7, and a blow-by gas treatment device 100. The cylinder head 3 is assembled onto the cylinder block 2. The head cover 4 made of aluminum is assembled onto the cylinder head 3. The cylinder block 2 has a cylinder 5 on an upper part and a crank case 6 on a lower part. The oil pun 7 is disposed on a lower part of the crank case 6. A piston 8 is disposed in the cylinder 5. A crank shaft 9 is disposed in the crank case 6. The piston 8 is connected to the crank shaft 9 via a con rod 10.

As illustrated in FIG. 1, the engine 1 includes a temperature raising mechanism 800 for the blow-by gas treatment device. The temperature raising mechanism 800 for the blow-by gas treatment device has the head cover 4, the blow-by gas treatment device 100, and heating means 600. The heating means 600 is fixed to an outer surface of the head cover 4. Details of the temperature raising mechanism 800 for the blow-by gas treatment device will be described later.

As shown in FIG. 1, the cylinder 5 has a valve cam chamber 11. The valve cam chamber 11 accommodates a valve cam shaft 12. A tappet 13 is capable of vertical movement along a tappet guide hole 14. A lower part of the tappet 13 is mounted on the valve cam shaft 12. A push rod 15 passes through an insertion hole 16. A rocker arm 17 is disposed in the head cover 4. An upper end part of the push rod 15 is in contact with the rocker arm 17.

The rocker arm 17 is urged to the upper end part side of the push rod 15 by a spring 18. An intake valve 19 and an exhaust valve 20 are vertically moved by power transmitted via the push rod 15 and the rocker arm 17 by means of rotation of the valve cam shaft 12 and opens/closes each of an intake port and an exhaust port.

As shown in FIG. 1, an oil flow-out hole 21, for example, is provided in the tappet 13. An oil drop hole 22 is provided from the valve cam chamber 11 to the crank case 6. As a result, the insertion hole 16, the inside of the tappet 13, the oil flow-out hole 21, the valve cam chamber 11, and the oil drop hole 22 constitute an oil return path 99. The oil return path 99 can return the oil in the head cover 4 to the oil pun 7 through the inside of the crank case 6. Each cylinder of the cylinder head 3 is connected to an intake passage 30 and an exhaust passage 31.

As shown in FIG. 1, at least in either one of a compression stroke and a combustion stroke of the engine 1, blow-by gas BG is generated in some cases. The blow-by gas BG is gas flowing into the crank case 6 through a gap between the piston 8 and the cylinder 5 and contains an uncombusted fuel component or a combusted gas component and a mist such as oil. The blow-by gas BG which leaks out of the gap between the cylinder 5 and the piston 8 to the crank case 6 rises into the head cover 4 through the oil return path 99 described above, for example. That is, when the blow-by gas BG leaks out of the gap between the cylinder 5 and the piston 8 to the crank case 6, it intrudes into the head cover 4 through the oil drop hole 22, the valve cam chamber 11, the oil flow-out hole 21 of the tappet 13, and the insertion hole 16 of the oil return path 99 as a blow-by gas passing path, for example.

As shown in FIG. 1 and FIG. 2, the blow-by gas treatment device 100 is provided in the head cover 4. The blow-by gas treatment device 100 has a role of separating the blow-by gas BG into oil OL (see FIG. 2) and gas (gas after the treatment) G (see FIG. 2) obtained by separating a mist of the oil OL. The gas G contained in the blow-by gas BG, for example, is sent to a piping 41 connected to an intake system outside the head cover 4 via the blow-by gas treatment device 100. The gas G contained in the blow-by gas BG is an uncombusted gas component excluding the oil OL and the mist of the oil OL from the blow-by gas BG and a combusted gas component, for example. It is to be noted that the oil (lubricant component) OL is collected by the oil pun 7 through the head cover 4, the inside of the cylinder head 3, and the oil return path 99, for example.

As shown in FIG. 1, a connecting pipe 50T and the piping 41 of an intake piping 50 are connected to each other by a blow-by gas mixed joint 70. When new intake AR is sucked into the intake piping 50, it passes through an air cleaner 52 and the connecting pipe 50T and enters a main piping 71 of the blow-by gas mixed joint 70. On the other hand, the gas G after the oil OL is separated from the blow-by gas BG by the blow-by gas treatment device 100 passes from an outlet portion 40 of the blow-by gas treatment device 100 through the piping 41 and enters a sub piping 72 of the blow-by gas mixed joint 70. As a result, the new intake AR and the gas G are mixed in the blow-by gas mixed joint 70 and become an intake air B.

On the other hand, the exhaust air from the exhaust passage 31 is supplied to a turbine 62 of a turbocharger 60, whereby the turbine 62 and a blower 61 are rotated at a high speed. The mixed intake air B is supplied to the blower 61 of the turbocharger 60 and is compressed. The compressed intake air C is supercharged to the intake passage 30 of the intake system.

(Blow-by Gas Treatment Device 100)

Subsequently, a preferred structure example of the blow-by gas treatment device 100 shown in FIG. 1 will be explained with reference to FIG. 2.

Here, an X-direction shown in FIG. 1 and FIG. 2 is a front-back direction of the engine 1 shown in FIG. 1, that is, an axial direction of the crank shaft 9. A Y-direction is a left-right direction of the engine 1. A Z-direction is an up-down direction (vertical direction) of the engine 1. The X, Y, Z directions are orthogonal to one another.

As shown in FIG. 1 and FIG. 2, the blow-by gas treatment device 100 is also referred to as a breather device or a breather and is disposed in the head cover 4. As shown in FIG. 2, the blow-by gas treatment device 100 can separate the blow-by gas BG into the oil OL and the gas G and guide the oil OL and the gas G by separate paths.

As shown in FIG. 1, the blow-by gas treatment device 100 has a main structure portion 101 and the outlet portion 40.

As shown in FIG. 2, the main structure portion 101 is provided in the head cover 4. The main structure portion 101 has a separating portion 330. The outlet portion 40 is provided by protruding above the head cover 4. The outlet portion 40 is disposed at a substantially center position CP, for example, with respect to the front-back direction, which is the X-direction of the main structure portion 101. The outlet portion 40 adjusts a pressure of the gas G which is to be supplied to the intake system of the engine 1 at the substantially center position CP, for example, of the engine 1 and sends only the gas G led from the main structure portion 101 to the piping 41 of the intake system of the engine 1. At the outlet portion 40, a pressure regulating valve (diaphragm), for example, is provided. The pressure regulating valve provided at the outlet portion 40 suppresses inflow of the new intake AR into the engine 1 through the blow-by gas mixed joint 70 and the piping 41 of the intake system shown in FIG. 1.

<Main Structure Portion 101 of Blow-by Gas Treatment Device 100>

A preferred structure example of the main structure portion 101 of the blow-by gas treatment device 100 will be explained with reference to FIG. 1 and FIG. 2.

As shown in FIG. 1 and FIG. 2, the head cover 4 has an upper surface part 4A, a front surface part 4B, a rear surface part 4C, and left and right surface parts 4D. The main structure portion 101 is disposed in a space surrounded by the upper surface part 4A, the front surface part 4B, the rear surface part 4C, and the left and right surface parts 4D. As shown in FIG. 2, the main structure portion 101 takes in and guides the blow-by gas BG and separates the oil OL and the gas G contained in the blow-by gas BG from the blow-by gas BG.

Then, the main structure portion 101 guides the oil OL and the gas G by separate paths so that the oil OL and the gas G separated from the blow-by gas BG do not leak to an outside of the engine 1. The head cover 4 is held by the cylinder head 3 in a state where the inside of the head cover 4 is held airtightly with respect to the outside of the head cover 4. As a result, leaking-out of the blow-by gas BG and the oil OL as well as the gas G separated from the blow-by gas BG to the outside of the engine 1 is suppressed.

As shown in FIG. 2, the main structure portion 101 substantially has a first blow-by gas taking-in portion 111, a second blow-by gas taking-in portion 112, the separating portion 330, a first oil guide-groove portion 151, a second oil guide-groove portion 152, a first oil drain 161, and a second oil drain 162. Each of the first oil guide-groove portion 151 and the second oil guide-groove portion 152 is an example of the "oil guiding portion" of the present invention.

As shown in FIG. 2, the main structure portion 101 has a partition wall part 200, a guide wall part 203, and a guide plate 295 in order to constitute the aforementioned constituent elements. The partition wall part 200 is disposed on an X-Y plane in the head cover 4, that is, horizontally, and partitions a lower region 4P and upper regions 4Q, 4R of the head cover 4. Therefore, the lower region 4P and the upper regions 4Q, 4R are spaces independent from each other. As described above, the partition wall part 200 partitions the inside of the head cover 4 into a plurality of regions.

As shown in FIG. 2, the guide wall part 203 reliably guides only the gas G after the treatment to the outlet portion 40. The guide wall part 203 is disposed between the partition wall part 200 and the upper surface part 4A of the head cover 4 and partitions the upper region 4Q and the upper region 4R.

<First Blow-by Gas Taking-In Portion 111 and Second Blow-by Gas Taking-In Portion 112>

Subsequently, the first blow-by gas taking-in portion 111 and the second blow-by gas taking-in portion 112 will be explained with reference to FIG. 2.

The first blow-by gas taking-in portion 111 and the second blow-by gas taking-in portion 112 are holes formed by the partition wall part 200 and the guide plate 295 and take in the blow-by gas BG. The partition wall part 200 is divided into a first guide lower-surface part 231 side and a second guide lower-surface part 232 side with the separating portion 330 at a center. The first blow-by gas taking-in portion 111 is provided at a position closer to the front surface part 4B (that is, on a front side of the engine 1) and takes in the blow-by gas BG from the front side. Moreover, the second blow-by gas taking-in portion 112 is provided at a position closer to the rear surface part 4C (that is, on a rear side of the engine 1) and takes in the blow-by gas BG from the rear side.

As shown in FIG. 1, when the blow-by gas BG having risen in the crank case 6 reaches the lower region 4P of the head cover 4 shown in FIG. 2, it passes through the first blow-by gas taking-in portion 111 and is taken in between the first guide lower-surface part 231 and the guide plate 295 of the partition wall part 200 and is guided toward the separating portion 330. Alternatively, the blow-by gas BG passes through the second blow-by gas taking-in portion 112 and is taken in between the second guide lower-surface part 232 and the guide plate 295 and is guided toward the separating portion 330. Then, the blow-by gas BG reaches an impactor 120 of the separating portion 330 at a center position RP with respect to the X-direction, which is the front-back direction.

<Temperature Raising Mechanism 800 of Blow-by Gas Treatment Device>

Subsequently, a preferred structure example of the temperature raising mechanism 800 for the blow-by gas treatment device according to this Embodiment will be explained with reference to the drawings.

Figure 3:
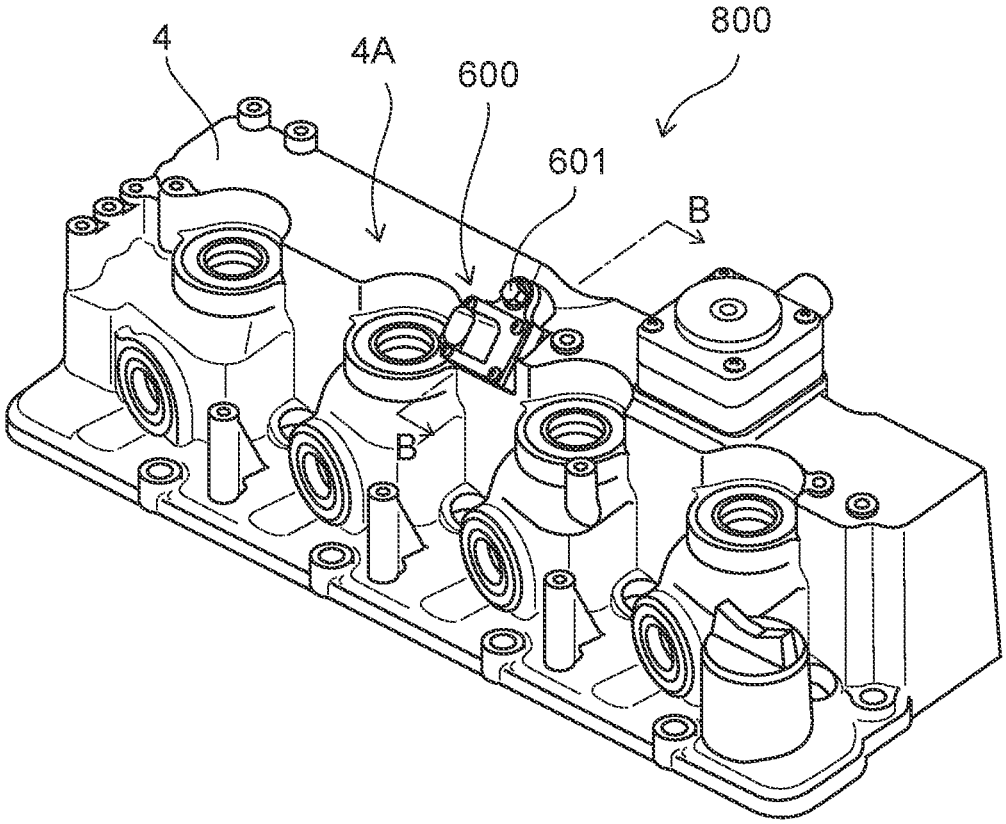
FIG. 3 is a perspective view illustrating the temperature raising mechanism for the blow-by gas treatment device according to the First Embodiment of the present invention.

FIG. 3 is a perspective view illustrating the temperature raising mechanism for the blow-by gas treatment device according to the First Embodiment of the present invention.

Figure 4:
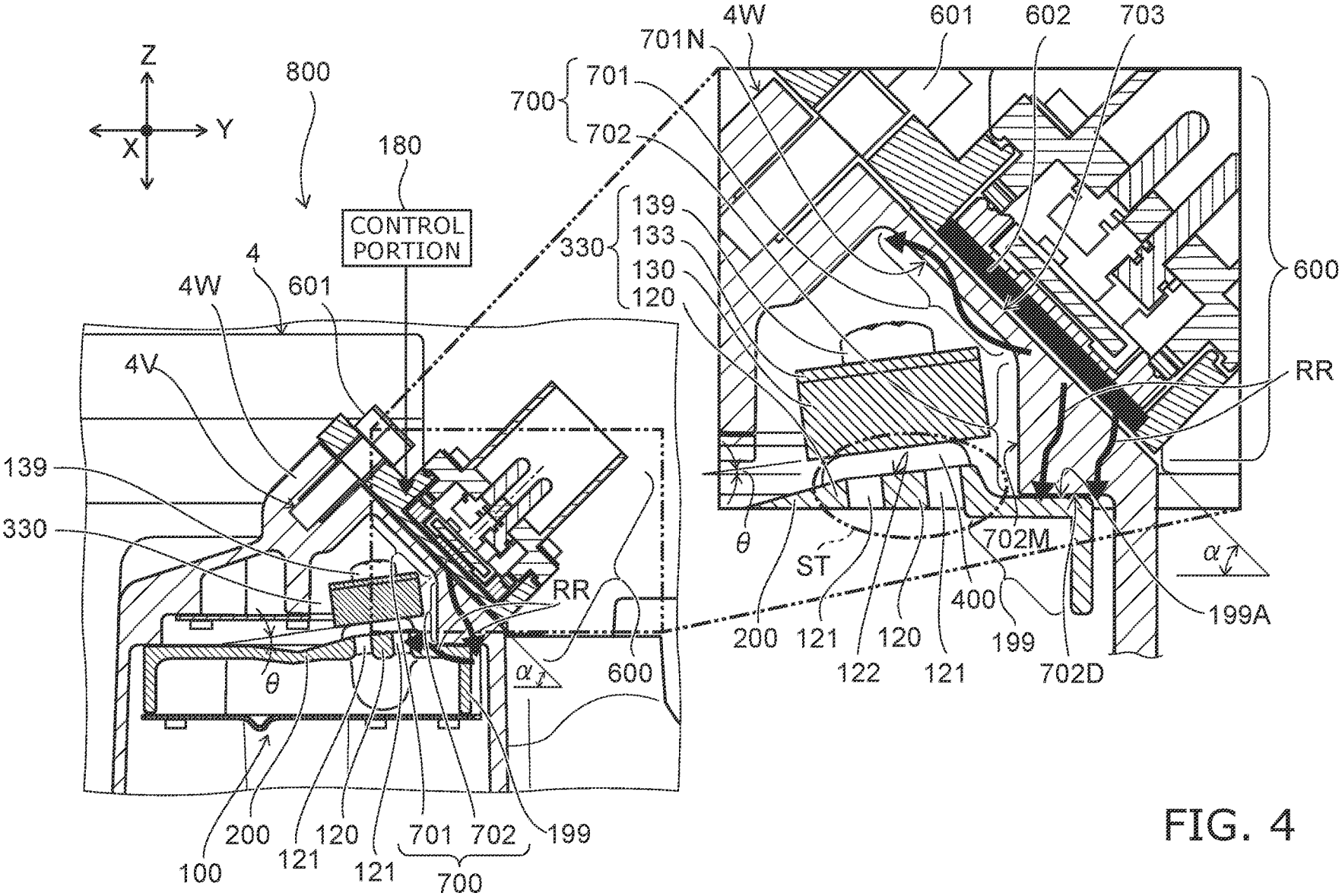
FIG. 4 is a sectional view illustrating heating means and an internal structure example of a head cover on a B-B line in FIG. 3.

FIG. 4 is a sectional view illustrating an internal structure example of heating means and the head cover on a B-B line in FIG. 3.

The temperature raising mechanism 800 for the blow-by gas treatment device according to this Embodiment has the head cover 4, the blow-by gas treatment device 100, and the heating means 600. The heating means 600 is replaceably fixed to the outer surface in the vicinity of the upper surface part 4A of the head cover 4 by using a mounting bolt 601.

The separating portion 330 of the blow-by gas treatment device 100 is also called an impactor-type separator and has the impactor 120, a filter 130, a collision plate 133, and screws 139, 139 for mounting. As illustrated in FIG. 2, the separating portion 330 is provided at the center position RP in the front-back direction of the engine 1.

As shown in FIG. 4, inside the head cover 4, the partition wall part 200 is provided. The partition wall part 200 is fixed to the head cover 4 and has a throttle hole 121 of the impactor 120 and a substantially L-shaped section type heat-conduction assisting portion 199. The separating portion 330 is provided with inclination only by a predetermined inclination angle θ with respect to a horizontal plane along the X-Y plane in the partition wall part 200. Specifically, as shown in FIG. 2, the separating portion 330 is provided with inclination in a direction in which the oil OL separated from the blow-by gas BG by the separating portion 330 is guided to the first oil guide-groove portion 151 and the second oil guide-groove portion 152. More specifically, as shown in FIG. 4, an upper surface 122 of the impactor 120 is inclined only by a predetermined inclination angle θ with respect to the horizontal plane along the X-Y plane. The upper surface 122 of the impactor 120 is inclined downward toward the first oil guide-groove portion 151 and the second oil guide-groove portion 152. The upper surface 122 of the impactor 120 of this Embodiment is an example of a "surface of the flow-velocity raising operation portion" of the present invention. It is to be noted that the separating portion 330 does not necessarily have to be inclined with respect to the horizontal plane along the X-Y plane but may be provided in parallel to the horizontal plane along the X-Y plane. Specifically, the upper surface 122 of the impactor 120 may be parallel to the horizontal plane along the X-Y plane.

The filter 130 and the collision plate 133 are placed on a setting portion 400 provided on the upper surface 122 of the impactor 120. The inclination angle θ is approximately 5 degrees or more and 45 degrees or less, for example. If the inclination angle θ is smaller than 5 degrees, the oil OL separated from the blow-by gas BG by the separating portion 330 cannot be rapidly guided to the first oil guide-groove portion 151 and the second oil guide-groove portion 152 via an oil outlet inclination-guiding portion 500. Alternatively, if the inclination angle θ is larger than 45 degrees, an effective opening area of an inlet part of the throttle hole 121 of the impactor 120 is narrowed, and the blow-by gas BG cannot be easily guided to the impactor 120.

The impactor 120 shown in FIG. 2 and FIG. 4 has a function of a nozzle or an orifice and preferably has at least two penetrating throttle holes 121. An axial direction of the throttle hole 121 does not follow the vertical direction or the up-down direction, which is the Z-direction, but is inclined only by the aforementioned inclination angle θ with respect to the Z-direction.

The impactor 120 is a flow-velocity raising operation portion which can raise the flow velocity of the blow-by gas BG by causing the blow-by gas BG to pass diagonally upward along the throttle hole 121. As shown in FIG. 2, the impactor 120 is provided at the center position RP in the front-back direction of the engine 1. As a result, the blow-by gas BG taken in by the first blow-by gas taking-in portion 111 and the blow-by gas BG taken in by the second blow-by gas taking-in portion 112 are uniformly guided to the impactor 120. The impactor 120 raises the flow velocity of the blow-by gas BG flowing into the throttle hole 121 and then, guides the blow-by gas BG to the filter 130. The filter 130 is made of a material such as glass wool, for example. The filter 130 is fixed by the mounting screw 139 so as to be sandwiched between the collision plate 133 and the setting portion 400 of the impactor 120. The collision plate 133 is a metal plate such as an iron plate, for example.

As exemplified in FIG. 2, the blow-by gas BG flows into the throttle hole 121 of the impactor 120 and diagonally rises, whereby the flow velocity is raised. The blow-by gas BG whose flow velocity has been raised passes through the filter 130, where foreign substances are removed, collides against the lower surface of the collision plate 133, and is separated into the oil OL and the gas G. The gas G separated from the blow-by gas BG by the separating portion 330 is emitted from the filter 130. The gas G not containing a mist of the oil OL emitted from the filter 130 is guided by the guide wall part 203, passes through a path 135 of the upper region 4Q and is led to the outlet portion 40.

On the other hand, the oil OL separated from the blow-by gas BG by the separating portion 330 drops through the filter 130 in FIG. 2 and drops onto the upper surface 122 of the impactor 120. The oil OL having dropped onto the upper surface 122 of the impactor 120 flows along the upper surface 122 of the impactor 120 and flows toward the first oil guide-groove portion 151 and the second oil guide-groove portion 152.

<Heating Means 600>

Subsequently, with reference to FIG. 4, a structure example of the heating means 600 will be explained.

As the heating means 600 shown in FIG. 4, a PTC heater (Positive temperature coefficient heater) is preferably used. However, the heating means 600 is not limited to the PTC heater. In the following explanation, a case in which the heating means is the PTC heater is cited as an example. A size of the PTC heater is small, and power consumption of the PTC heater is small. Moreover, the PTC heater is a heating body using a semiconductor ceramic material with barium titanate ($BaTiO_3$) as a main component and has a positive temperature characteristic. The PTC heater can rapidly increase a resistance value at a temperature (Curie temperature) when the temperature rises by combining another component with the main component.

In the heating means 600 shown in FIG. 4, when a voltage is applied in accordance with an instruction of a control portion 180, a large amount of the electric current flows at a low temperature so as to increase a heat generation amount, and as the heat is generated, the resistance value increases, the electric current is limited, and the heat generation amount is suppressed. By means of a self-temperature control function of the ceramic material of the PTC heater, the temperature of the heating means 600 does not rise to a temperature higher than a vicinity of a Curie point temperature. The Curie point temperature of the heating means 600 of this Embodiment is a temperature lower than a temperature at which the oil OL contained in the blow-by gas BG is carbonized and is 85° C. to 105° C., for example. That is, though the PTC heater is small-sized and has a low power consumption, it is effective for a device on which the engine 1 shown in FIG. 1 is mounted to avoid freezing of moisture contained in the oil OL at a low temperature in the impactor 120 by a large heat generation amount.

As shown in FIG. 3 and FIG. 4, the heating means 600 is disposed with inclination with respect to the head cover 4. Specifically, the heating means 600 is inclined only by an inclination angle α with respect to the X-Y plane as shown in FIG. 4. That is, the heating means 600 is provided with inclination by the inclination angle α of 45 degrees, for example, along a direction crossing the X-Y plane including the axial direction of the crank shaft 9 of the engine 1 shown in FIG. 1. The inclination angle α is not limited to 45 degrees, but an arbitrary angle can be set. The heating means 600 is mounted by screwing the mounting bolt 601 to a female thread part 4V of an inclined thick part 4W of the head cover 4. The heating means 600 can be replaced if the heating means 600 fails, for example, by removing the mounting bolt 601.

As shown in FIG. 4, the head cover 4 has a heat conducting portion 700. Moreover, the heat conducting portion 700 has an inclined part 701 and a thick part 702 for heat conduction. The thick part 702 for heat conduction of the heat conducting portion 700 is in contact with the heat-conduction assisting portion 199 of the partition wall part 200. On outer surfaces of the inclined part 701 and the thick part 702 for heat conduction, a mounting plane 703 is formed. The mounting plane 703 in this Embodiment is an example of the "outer surface of the head cover" of the present invention. The heating means 600 of this Embodiment is placed and fixed to the mounting plane 703.

As described above, the heating means 600 is disposed with inclination with respect to the head cover 4. Specifically, the mounting plane 703 is inclined with respect to an upper surface 199A of the heat-conduction assisting portion 199. An angle between the mounting plane 703 and the upper surface 199A of the heat-conduction assisting portion 199 corresponds to the aforementioned inclination angle α. Therefore, by using a space between the head cover 4 and the separating portion 330, the thick part 702 for heat conduction of the heat conducting portion 700 which is thicker than the other parts of the head cover 4 can be provided. Therefore, the heat generated by the heating means 600 is efficiently conducted to the separating portion 330 through the thick part 702 for heat conduction of the heat conducting portion 700.

The inclined part 701 is formed between the inclined thick part 4W and the thick part 702 for heat conduction and is not in contact with the heat-conduction assisting portion 199 of the partition wall part 200. The inclined part 701 of this Embodiment is an example of "the other parts in the heat conducting portion not in contact with the partition wall part" of the present invention. The thickness of the inclined part 701 is smaller than the thickness of the inclined thick part 4W. The thickness of the thick part 702 for heat conduction is set larger than the thickness of the inclined part 701. Moreover, an inner surface 701N of the inclined part 701 is inclined by the inclination angle α. Preferably, an inner surface 702M of the thick part 702 for heat conduction is formed perpendicular along the X-Z plane.

The thick part 702 for heat conduction has a function of directly conducting the heat generated by a PTC element portion 602 along a heat conduction path RR indicated by an arrow to the heat-conduction assisting portion 199 of the partition wall part 200. As a result, the heat generated by the PTC element portion 602 can be reliably conducted to the two throttle holes 121 of the separating portion 330 via the heat-conduction assisting portion 199 along the heat conduction path RR. As described above, the heat-conduction assisting portion 199 of the partition wall part 200 is in contact with the heat conducting portion 700 of the head cover 4, receives the heat generated by the heating means 600 via the heat conducting portion 700, and conducts it to the separating portion 330. The heating means 600 includes the PTC element portion 602, a circuit board, and a required circuit element. A heat generating surface of the PTC element portion 602 is in close contact with the mounting plane 703 of the heat conducting portion 700 of the head cover 4. A lower surface 702D of the thick part 702 for heat conduction is mechanically and moreover, thermally in close contact with the heat-conduction assisting portion 199 of the partition wall part 200.

(Operation Example of Heating Means 600)

Subsequently, an operation example of the heating means 600 when the aforementioned engine 1 is used will be explained.

A case in which a device on which the engine 1 shown in FIG. 1 is mounted is operated under a use environment temperature of a low temperature of −35° C., for example, is cited as an example. Though it is outside the scope of the present invention, if the aforementioned heating means 600 is not equipped in the head cover 4, there is a concern that the two throttle holes 121 of the separating portion 330 in a region ST indicated by a broken line illustrated in FIG. 4 are blocked by freezing of the moisture contained in the oil OL of the blow-by gas BG. If the two throttle holes 121 are blocked, there is a concern that an internal pressure of the crank case 6 rises, and an optional seal portion provided in the engine 1 is broken.

Thus, in the First Embodiment of the present invention, in order to prevent the blockage by the freezing of the moisture at the two throttle holes 121 of the separating portion 330, as illustrated in FIG. 4, the thick part 702 for heat conduction of the heat conducting portion 700 conducts heat generated by the PTC element portion 602 of the heating means 600 directly to the heat-conduction assisting portion 199 of the partition wall part 200 along the heat conduction path RR indicated by the arrow.

As a result, the heat generated by the PTC element portion 602 can be reliably conducted to the two throttle holes 121 of the separating portion 330 via the heat-conduction assisting portion 199. Thus, the blockage of the two throttle holes 121 of the separating portion 330 in the region ST indicated by the broken line shown in FIG. 4 by the freezing of the moisture contained in the oil OL of the blow-by gas BG can be prevented. Therefore, a rise of the internal pressure of the crank case 6 can be suppressed, and the breakage of the optional seal portion provided in the engine 1 can be suppressed.

As described above, since the thickness of the thick part 702 for heat conduction is set larger than the thickness of the inclined part 701, a sectional area of the thick part 702 for heat conduction is set larger than a sectional area of the inclined part 701. Since outside air temperatures of the thick part 702 for heat conduction and the inclined part 701 are substantially the same, the thick part 702 for heat conduction having a relatively larger sectional area can conduct the heat generated by the PTC element portion 602 more easily than the inclined part 701 having a relatively smaller sectional area. Thus, the heat generated by the PTC element portion 602 can be conducted directly and more reliably to the thick part 702 for heat conduction and the heat-conduction assisting portion 199 of the partition wall part 200 along the heat conduction path RR indicated by the arrow.

As the result of experiments conducted by the inventor of this application, a temperature rise of the two throttle holes 121 of the separating portion 330 could be actually confirmed, and an internal pressure rise of the crank case 6 by the freezing at the separating portion 330 was not found.

In order to prevent the blockage by the freezing of the moisture in the throttle hole 121, it is preferable that the temperature in the vicinity of the throttle hole 121 is set to approximately 0° C., and a far higher temperature than 0° C. such as 10° C. or more, for example, does not have to be set.

Moreover, since the heat generated by the PTC element portion 602 is conducted to the two throttle holes 121 of the separating portion 330 via the thick part 702 for heat conduction and the heat-conduction assisting portion 199, as compared with the case where the heating means 600 directly heats the parts of the two throttle holes 121 of the separating portion 330, the part of the two throttle holes 121 of the separating portion 330 can be suppressed from rising to a high temperature. Thus, the carbonization of the oil OL part in the blow-by gas BG can be prevented. Therefore, a blockage risk that the carbonized oil blocks the throttle hole 121 can be also avoided.

Moreover, when the heating means 600 is installed inside the head cover 4, a sealing performance is needed for the part of the heating means 600 inserted into the head cover 4, but in this Embodiment, since the heating means 600 is mounted on the mounting plane 703 as the outer surface of the head cover 4, the structure of the head cover 4 can be suppressed from becoming complicated.

According to the temperature raising mechanism 800 for the blow-by gas treatment device according to this Embodiment, the heat conducting portion 700 of the head cover 4 is in contact with the partition wall part 200 and conducts the heat generated by the heating means 600 to the separating portion 330. As a result, the temperature raising mechanism 800 for the blow-by gas treatment device according to this Embodiment can suppress the freezing of the moisture contained in the blow-by gas BG at a low temperature in the separating portion 330. Moreover, the heat generated by the heating means 600 is not directly conducted to the separating portion 330 but is conducted to the separating portion 330 via the heat conducting portion 700 of the head cover 4 in contact with the partition wall part 200 of the blow-by gas treatment device 100. As a result, the temperature raising mechanism 800 for the blow-by gas treatment device according to this Embodiment suppresses the separating portion 330 from becoming a high temperature, while it can suppress the freezing of the moisture contained in the blow-by gas BG at a low temperature in the separating portion 330, while the oil OL contained in the blow-by gas BG is carbonized.

Moreover, the mounting plane 703 of the head cover 4 to which the heating means 600 is fixed is inclined with respect to the upper surface 199A of the heat-conduction assisting portion 199 of the partition wall part 200. Thus, a space for forming the heat conducting portion 700 of the head cover 4 thicker than the other parts of the head cover 4 can be ensured inside the head cover 4. As a result, by using this space, the heat conducting portion 700 which is thicker than the other parts of the head cover 4 is provided, and the contact area between the heat conducting portion 700 of the head cover 4 and the heat-conduction assisting portion 199 of the partition wall part 200 can be set wider. Therefore, the temperature raising mechanism 800 for the blow-by gas treatment device according to this Embodiment can efficiently conduct the heat generated by the heating means 600 to the separating portion 330 via the heat conducting portion 700 of the head cover 4 and the heat-conduction assisting portion 199 of the partition wall part 200 and can further suppress the freezing of the moisture contained in the blow-by gas BG at a low temperature in the separating portion 330.

Moreover, when the heating means 600 is the PTC heater, it has a resistance value which rapidly increases at a certain temperature, when the temperature rises. In this case, in the heating means 600, a large amount of the electric current flows at a low temperature so as to increase the heat generation amount, and as the heat is generated, the resistance value increases, the electric current is limited, and the heat generation amount can be suppressed. Therefore, the temperature raising mechanism 800 for the blow-by gas treatment device according to this Embodiment can suppress the freezing of the moisture contained in the blow-by gas BG at a low temperature in the separating portion 330, while the separating portion 330 is suppressed from becoming a high temperature, and carbonization of the oil OL contained in the blow-by gas BG is suppressed.

The thickness of the thick part 702 for heat conduction in the heat conducting portion 700 in contact with the partition wall part 200 is larger than the thickness of the inclined part 701 in the heat conducting portion 700 not in contact with the partition wall part 200. Thus, the heat generated by the heating means 600 is conducted to the thick part 702 for heat conduction more easily than the inclined part 701. Moreover, as compared with the inclined part 701, a heat capacity of the thick part for heat conduction can be increased. As a result, the temperature raising mechanism 800 for the blow-by gas treatment device according to this Embodiment efficiently conducts the heat generated by the heating means 600 to the separating portion 330 and can further suppress the freezing of the moisture contained in the blow-by gas BG at a low temperature in the separating portion 330.

Moreover, since the separating portion 330 is inclined in the direction in which the oil OL separated from the blow-by gas BG by the separating portion 330 is led to the first oil guide-groove portion 151 and the second oil guide-groove portion 152, the oil OL separated from the blow-by gas BG can be led to the first oil guide-groove portion 151 and the second oil guide-groove portion 152 more reliably. As a result, the temperature raising mechanism 800 for the blow-by gas treatment device according to this Embodiment can suppress staying of the oil OL in the separating portion 330 and suppress the freezing of the moisture contained in the oil OL of the blow-by gas BG at a low temperature in the separating portion 330.

Moreover, the impactor 120 as the flow-velocity raising operation portion causes the blow-by gas BG to collide against the collision plate 133 while the flow velocity of the blow-by gas BG is caused to rise along the direction inclined with respect to the vertical direction (up-down direction). As a result, the blow-by gas BG is reliably separated into the oil OL and the gas G. And the oil OL separated from the blow-by gas BG at the collision plate 133 passes through the filter 130 and drops onto the upper surface 122 of the impactor 120 opposed to the collision plate 133. Here, the upper surface 122 of the impactor 120 is inclined downward toward the first oil guide-groove portion 151 and the second oil guide-groove portion 152. Thus, the oil OL having dropped onto the upper surface 122 of the impactor 120 flows on the upper surface 122 of the impactor 120 by its own weight and is led to the first oil guide-groove portion 151 and the second oil guide-groove portion 152. As a result, the temperature raising mechanism 800 for the blow-by gas treatment device according to this Embodiment suppresses staying of the oil OL in the separating portion 330 and can suppress the freezing of the moisture contained in the oil OL of the blow-by gas BG at a low temperature in the separating portion 330.

Second Embodiment

Subsequently, with reference to FIG. 5 and FIG. 6, a Second Embodiment of the present invention will be explained. When constituent elements of the Second Embodiment of the present invention are substantially the same as the constituent elements of the aforementioned First Embodiment of the present invention, the same signs are given, and the explanation thereof will be omitted.

Figure 5:
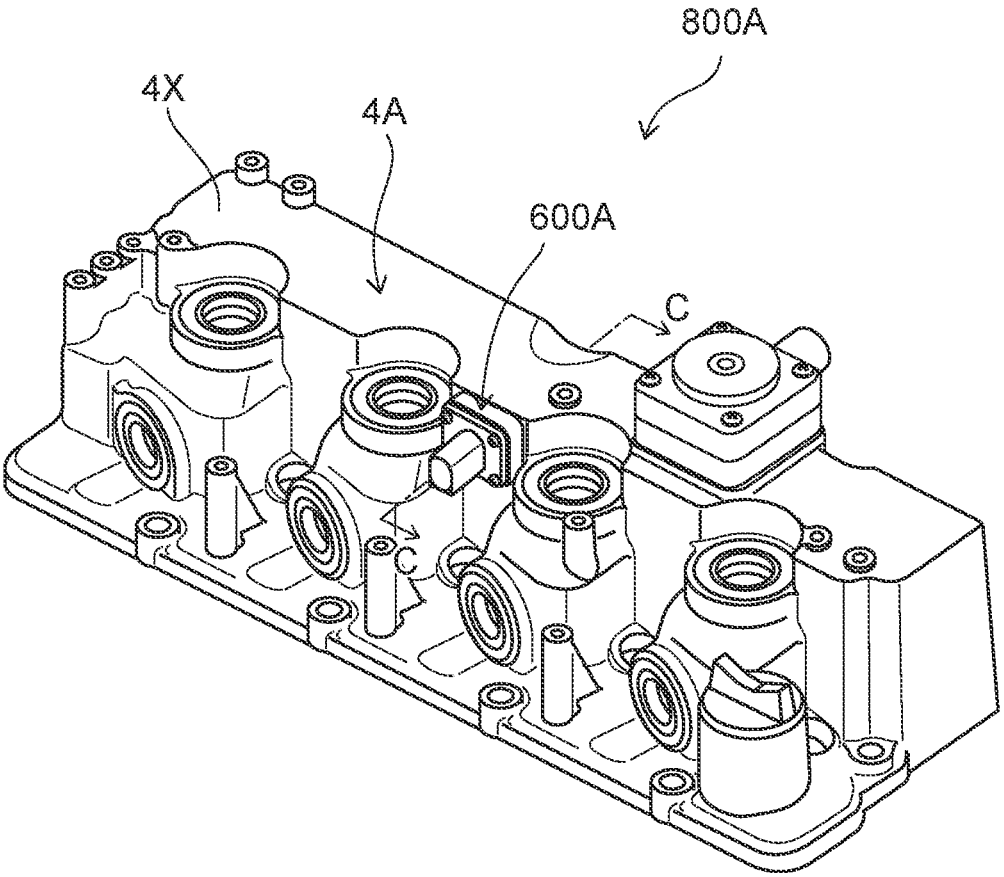
FIG. 5 is a perspective view illustrating a temperature raising mechanism for a blow-by gas treatment device according to a Second Embodiment of the present invention.

FIG. 5 is a perspective view illustrating a temperature raising mechanism for a blow-by gas treatment device according to the Second Embodiment of the present invention.

Figure 6:
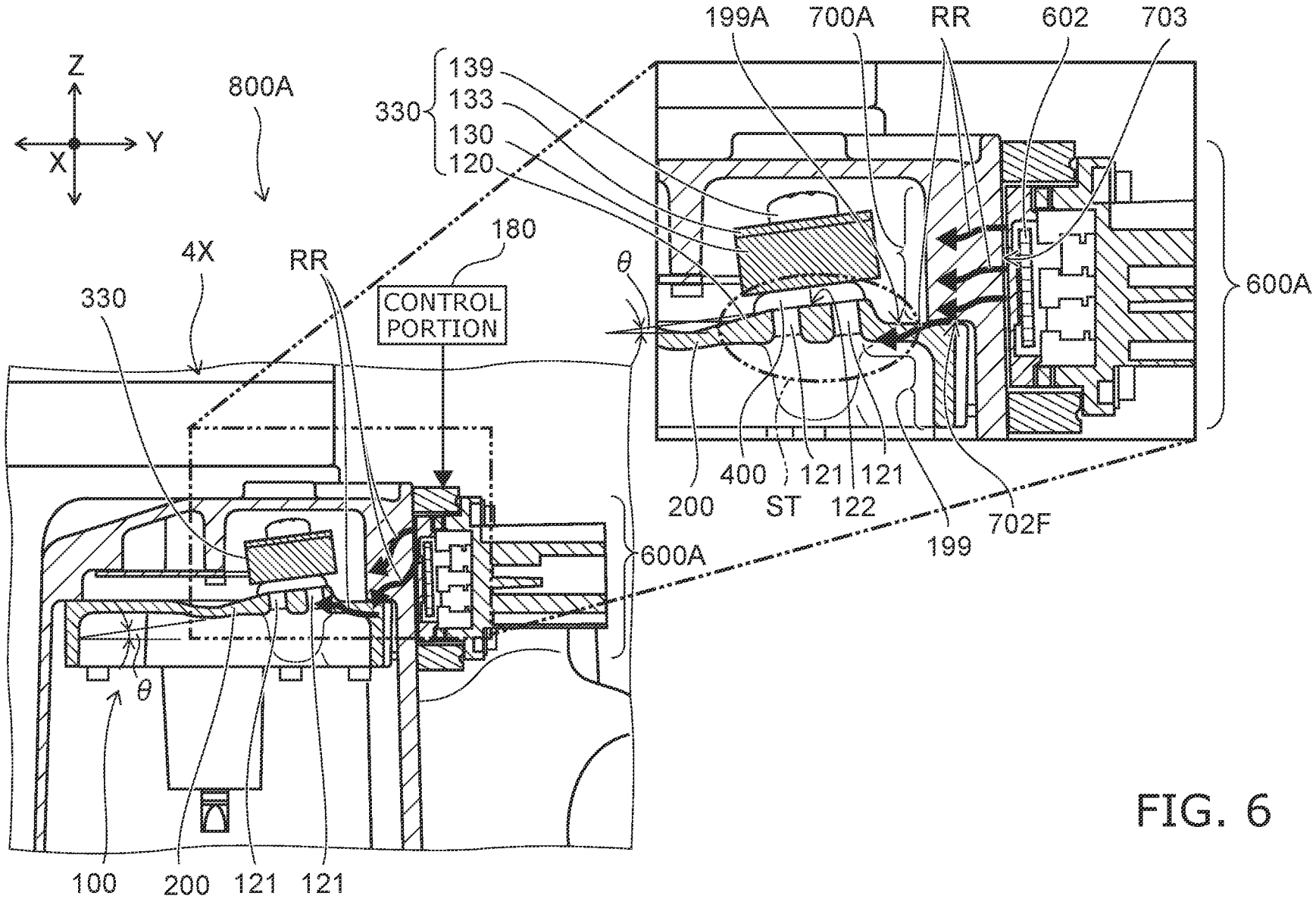
FIG. 6 is a sectional view illustrating heating means and an internal structure example of a head cover on a C-C line in FIG. 5.

FIG. 6 is a sectional view illustrating an internal structure example of heating means and a head cover on a C-C line in FIG. 5.

In the First Embodiment of the present invention having been already explained, as shown in FIG. 3 and FIG. 4, the heating means 600 is provided with inclination by the inclination angle $\alpha$ with respect to the head cover 4. On the other hand, in a temperature raising mechanism 800A for a blow-by gas treatment device according to the Second Embodiment of the present invention, as shown in FIG. 5 and FIG. 6, heating means 600A is provided along substantially a perpendicular direction with respect to a head cover 4X, that is, substantially the perpendicular direction with respect to the X-Y plane substantially including an axial direction of the crank shaft 9. Specifically, the mounting plane 703 is perpendicular to an upper surface 199A of the heat-conduction assisting portion 199. This point is different from the case of the heating means 600 in the First Embodiment.

As shown in FIG. 6, the heating means 600A includes the PTC element portion 602, a circuit board, and a required circuit element. A heat generating surface of the PTC element portion 602 is in close contact with the mounting plane 703 of a heat conducting portion 700A of the head cover 4X. The heat conducting portion 700A is a thick part formed substantially perpendicularly and has a rectangular sectional shape. A lower surface 702F of the heat conducting portion 700A is mechanically and moreover, thermally in close contact with the heat-conduction assisting portion 199 of the partition wall part 200.

The heat conducting portion 700A has a function of directly conducting the heat generated by the PTC element portion 602 to the heat-conduction assisting portion 199 of the partition wall part 200 along the heat conduction path RR indicated by an arrow. As a result, the heat generated by the PTC element portion 602 can be conducted to the two throttle holes 121 of the separating portion 330 via the heat-conduction assisting portion 199.

As a result, blockage of the two throttle holes 121 of the separating portion 330 in the region ST indicated by a broken line shown in FIG. 6 by freezing of moisture contained in the oil OL of the blow-by gas BG can be prevented. The thickness of the heat conducting portion 700A is set larger than the thickness of the other parts. Therefore, the heat conducting portion 700A can conduct the heat generated by the PTC element portion 602 to the two throttle holes 121 of the separating portion 330 via the heat-conduction assisting portion 199 more easily.

The heating means 600A is provided simply in the up-down direction (vertical direction). And the heat generated by the heating means 600A can be efficiently conducted via the heat conducting portion 700A. Thus, the heat generated by the heating means 600A can be efficiently conducted to the two throttle holes 121 of the separating portion 330 via the heat-conduction assisting portion 199, while a disposition structure of the heating means 600A is simplified. Since the thickness of the heat conducting portion 700A is larger than the thickness of the other parts of the head cover 4X, the heat capacity of the heat conducting portion 700A can be increased, and the heat generated by the heating means 600A can be efficiently conducted to the separating portion 330.

According to the temperature raising mechanism 800A for the blow-by gas treatment device according to this Embodiment, the mounting plane 703 of the head cover 4X to which the heating means 600 is fixed is perpendicular to the upper surface 199A of the heat-conduction assisting portion 199. Thus, a contact area between the heat conducting portion 700 of the head cover 4X and the heat-conduction assisting portion 199 of the partition wall part 200 can be ensured, while the disposition structure of the heating means 600 is simplified. As a result, the temperature raising mechanism 800A for the blow-by gas treatment device according to this Embodiment can efficiently conduct the heat generated by the heating means 600 to the separating portion 330 via the heat conducting portion 700 of the head cover 4X and the heat-conduction assisting portion 199 of the partition wall part 200, while complication of the disposition structure of the heating means 600 is suppressed.

As described above, the Embodiments of the present invention have been explained. However, the present invention is not limited to the aforementioned Embodiments but is capable of various changes within a range not departing from the scope of claims. The configurations of the aforementioned Embodiments may be partially omitted or combined arbitrarily so as to be different from the above.

The heating means 600, 600A use the PTC heater, for example, but other types of the heating means such as the one with a structure in which an electrothermal wire is disposed on a circuit board, for example, may be employed and not particularly limited. The separating portion 330 is disposed with inclination in the illustrated examples but may be disposed horizontally along the X-Y plane.

As an example of the engine of the present invention, the engine 1 according to this Embodiment is exemplified. The engine 1 is a supercharging type diesel engine with a turbocharger. However, this is not limiting, and the engine of the present invention may be a natural-intake type diesel engine, a supercharging type gasoline engine with a turbocharger, a natural-intake gasoline engine and the like.

REFERENCE SIGNS LIST

1 Engine
2 Cylinder block
3 Cylinder head
4 Head cover
4A Upper surface part
4B Front surface part
4C Rear surface part
4D Left/right surface part
4P Lower region
4Q Upper region
4R Upper region
4V Female thread part
4W Inclined thick part
4X Head cover
5 Cylinder
6 Crank case
7 Oil pun
8 Piston
9 Crank shaft
10 Con rod
11 Valve cam chamber
12 Valve cam shaft
13 Tappet
14 Tappet guide hole
15 Push rod
16 Insertion hole
17 Rocker arm
18 Spring
19 Intake valve
20 Exhaust valve
21 Oil flow-out hole
22 Oil drop hole
30 Intake passage
31 Exhaust passage
40 Outlet portion
41 Piping
50 Intake piping
50T Connection pipe
52 Air cleaner
60 Turbocharger
61 Blower
62 Turbine
70 Blow-by gas mixed joint
71 Main piping
72 Sub piping
99 Oil return path
100 Blow-by gas treatment device
101 Main structure portion
111 First blow-by gas taking-in portion
112 Second blow-by gas taking-in portion
120 Impactor
121 Throttle hole
122 Upper surface
130 Filter
133 Collision plate
135 Path
139 Screw
151 First oil guide-groove portion
152 Second oil guide-groove portion
161 First oil drain
162 Second oil drain
180 Control portion
199 Heat-conduction assisting portion
199A Upper surface
200 Partition wall part
203 Guide wall part
231 First guide lower-surface part
232 Second guide lower-surface part
295 Guide plate
330 Separating portion
400 Setting portion
500 Oil outlet inclination-guiding portion
600, 600A Heating means
601 Mounting bolt
602 PTC element portion
700 Heat conducting portion
700A Heat conducting portion
701 Inclined part

701N Inner surface
702 Thick part for heat conduction
702D, 702F Lower surface
702M Inner surface
703 Mounting plane
800, 800A Temperature raising mechanism for a blow-by gas treatment device
AR Intake
B Intake air
BG Blow-by gas
C Intake air
G Gas
OL Oil

The invention claimed is:

1. A temperature raising mechanism for a blow-by gas treatment device which treats blow-by gas generated in an engine, comprising:

a head cover which is assembled to a cylinder head of the engine;

the blow-by gas treatment device which is disposed in the head cover and treats the blow-by gas; and heating means which is fixed to an outer surface of the head cover and generates heat, wherein the blow-by gas treatment device has:

a partition wall part which is fixed to the head cover and partitions an inside of the head cover into a plurality of regions; and a separating portion which is provided in the partition wall part and separates the blow-by gas into oil and gas;

the separating portion has a flow-velocity raising operation portion which has a throttle hole and an impactor structure aligned close to said throttle hole raising a flow velocity of the blow-by gas by causing the blow-by gas to pass through the throttle hole; and the head cover has a heat conducting portion which is in contact with the partition wall part and conducts the heat generated by the heating means to the throttle hole of the separating portion via the partition wall part.

2. The temperature raising mechanism for the blow-by gas treatment device according to claim 1, wherein the partition wall part has a heat-conduction assisting portion which is in contact with the heat conducting portion, receives the heat generated by the heating means, and conducts the heat to the throttle hole of the separating portion; and the outer surface is inclined with respect to an upper surface of the heat-conduction assisting portion.

3. The temperature raising mechanism for the blow-by gas treatment device according to claim 1, wherein the partition wall part has a heat-conduction assisting portion which is in contact with the heat conducting portion, receives the heat generated by the heating means, and conducts the heat to the throttle hole of the separating portion; and the outer surface is perpendicular with respect to an upper surface of the heat-conduction assisting portion.

4. The temperature raising mechanism for the blow-by gas treatment device according to claim 1, wherein the heating means is a heater which has a positive temperature characteristic using a semiconductor ceramic with barium titanate as a main component.

5. The temperature raising mechanism for the blow-by gas treatment device according to claim 1, wherein a thickness of a part in the heat conducting portion in contact with the partition wall part is larger than the thickness of the other parts in the heat conducting portion not in contact with the partition wall part.

6. The temperature raising mechanism for the blow-by gas treatment device according to claim 1, wherein the separating portion is provided with inclination in a direction in which the oil separated from the blow-by gas by the separating portion is led to an oil guiding portion.

7. The temperature raising mechanism for the blow-by gas treatment device according to claim 6, wherein the flow-velocity raising operation portion raises the flow velocity of the blow-by gas along a direction inclined with respect to a vertical direction;

the separating portion further has:

a filter through which the blow-by gas whose flow velocity is raised by the flow-velocity raising operation portion is passed; and a collision plate against which the blow-by gas having passed through the filter is caused to collide and is separated to the oil and the gas; and a surface of the flow-velocity raising operation portion opposed to the collision plate is inclined downward toward the oil guiding portion.

8. An engine including a temperature raising mechanism for a blow-by gas treatment device which treats blow-by gas generated in the engine, wherein the temperature raising mechanism for the blow-by gas treatment device has:

a head cover which is assembled to a cylinder head of the engine;

the blow-by gas treatment device which is disposed in the head cover and treats the blow-by gas; and heating means which is fixed to an outer surface of the head cover and generates heat; and the blow-by gas treatment device has:

a partition wall part which is fixed to the head cover and partitions an inside of the head cover into a plurality of regions; and a separating portion which is provided in the partition wall part and separates the blow-by gas into oil and gas;

the separating portion has a flow-velocity raising operation portion which has a throttle hole and an impactor structure aligned close to said throttle hole raising a flow velocity of the blow-by gas by causing the blow-by gas to pass through the throttle hole; and the head cover has a heat conducting portion which is in contact with the partition wall part and conducts heat generated by the heating means to the throttle hole of the separating portion via the partition wall part.

9. The temperature raising mechanism for the blow-by gas treatment device according to claim 2, wherein the heating means is a heater which has a positive temperature characteristic using a semiconductor ceramic with barium titanate as a main component.

10. The temperature raising mechanism for the blow-by gas treatment device according to claim 3, wherein the heating means is a heater which has a positive temperature characteristic using a semiconductor ceramic with barium titanate as a main component.

11. The temperature raising mechanism for the blow-by gas treatment device according to claim 2, wherein a thickness of a part in the heat conducting portion in contact with the partition wall part is larger than the thickness of the other parts in the heat conducting portion not in contact with the partition wall part.

12. The temperature raising mechanism for the blow-by gas treatment device according to claim 3, wherein a thickness of a part in the heat conducting portion in contact with the partition wall part is larger than the thickness of the other parts in the heat conducting portion not in contact with the partition wall part.

13. The temperature raising mechanism for the blow-by gas treatment device according to claim 4, wherein a thickness of a part in the heat conducting portion in contact with the partition wall part is larger than the thickness of the other parts in the heat conducting portion not in contact with the partition wall part.

14. The temperature raising mechanism for the blow-by gas treatment device according to claim 9, wherein a thickness of a part in the heat conducting portion in contact with the partition wall part is larger than the thickness of the other parts in the heat conducting portion not in contact with the partition wall part.

15. The temperature raising mechanism for the blow-by gas treatment device according to claim 10, wherein a thickness of a part in the heat conducting portion in contact with the partition wall part is larger than the thickness of the other parts in the heat conducting portion not in contact with the partition wall part.

16. The temperature raising mechanism for the blow-by gas treatment device according to claim 2, wherein the separating portion is provided with inclination in a direction in which the oil separated from the blow-by gas by the separating portion is led to an oil guiding portion.

17. The temperature raising mechanism for the blow-by gas treatment device according to claim 3, wherein the separating portion is provided with inclination in a direction in which the oil separated from the blow-by gas by the separating portion is led to an oil guiding portion.

18. The temperature raising mechanism for the blow-by gas treatment device according to claim 4, wherein the separating portion is provided with inclination in a direction in which the oil separated from the blow-by gas by the separating portion is led to an oil guiding portion.

19. The temperature raising mechanism for the blow-by gas treatment device according to claim 5, wherein the separating portion is provided with inclination in a direction in which the oil separated from the blow-by gas by the separating portion is led to an oil guiding portion.

20. The temperature raising mechanism for the blow-by gas treatment device according to claim 9, wherein the separating portion is provided with inclination in a direction in which the oil separated from the blow-by gas by the separating portion is led to an oil guiding portion.

* * * * *